United States Patent [19]

Philpot

[11] Patent Number: 4,767,100

[45] Date of Patent: Aug. 30, 1988

[54] DRILLING RIG WITH HOIST TRANSPORTABLE BY A VEHICLE

[76] Inventor: Gearld Philpot, 1909 Woodland Dr., Ada, Okla. 74820

[21] Appl. No.: 298,066

[22] Filed: Aug. 31, 1981

[51] Int. Cl.[4] ..... B66D 1/08

[52] U.S. Cl. ..... 254/386

[58] Field of Search ..... 254/386, 280, 281, 282, 254/323, 326, 327, 335, 336; 173/28, 85, 147, 152; 92/77

[56] References Cited

U.S. PATENT DOCUMENTS

| | | |
|---|---|---|
| 1,363,586 | 12/1920 | Hansen . |
| 1,501,464 | 7/1924 | Patterson . |
| 1,668,861 | 5/1928 | Mercer . |
| 1,781,707 | 11/1930 | Sheldon . |
| 2,105,722 | 1/1938 | Barrett et al. . |
| 2,276,016 | 3/1942 | Brantly . |
| 2,294,318 | 8/1942 | Rich . |
| 2,904,310 | 9/1959 | Leonard . |
| 3,181,630 | 5/1964 | Coburn . |
| 3,502,543 | 3/1970 | Sewell . |
| 3,692,123 | 9/1972 | Gyongyosi . |
| 3,719,238 | 3/1973 | Campbell et al. . |
| 3,835,940 | 9/1974 | Winter, Jr. . |

*Primary Examiner*—John M. Jillions

*Attorney, Agent, or Firm*—Dunlap, Codding & Peterson

[57] ABSTRACT

An improved drilling rig which is mounted on a trailer to be transported from one location to another. The drilling rig includes a hoist for raising and lowering equipment, the hoist including hydraulic cylinders and a pair of cables. One end of each cable is connected to a base and the opposite end of each cable forms an equipment end portion which is connectable to the equipment to be raised and lowered, a portion of each cable being moveably connectable to a portion of the hydraulic cylinders. Portions of the hydraulic cylinders are moveable to raised and lowered positions for raising and lowering the equipment end portions of the cable and the equipment connected thereto.

10 Claims, 3 Drawing Sheets

DRILLING RIG WITH HOIST TRANSPORTABLE BY A VEHICLE

BACKGROUND OF THE INVENTION

FIELD OF THE INVENTION

The present invention generally relates to a drilling rig with a hoist for raising and lowering equipment and, more particularly, but not by way of limitation, to a drilling rig with a hoist which is transportable via a vehicle for moving the drilling rig from one location to another.

BRIEF DESCRIPTION OF THE PREFERRED EMBODIMENT

Figure 1:
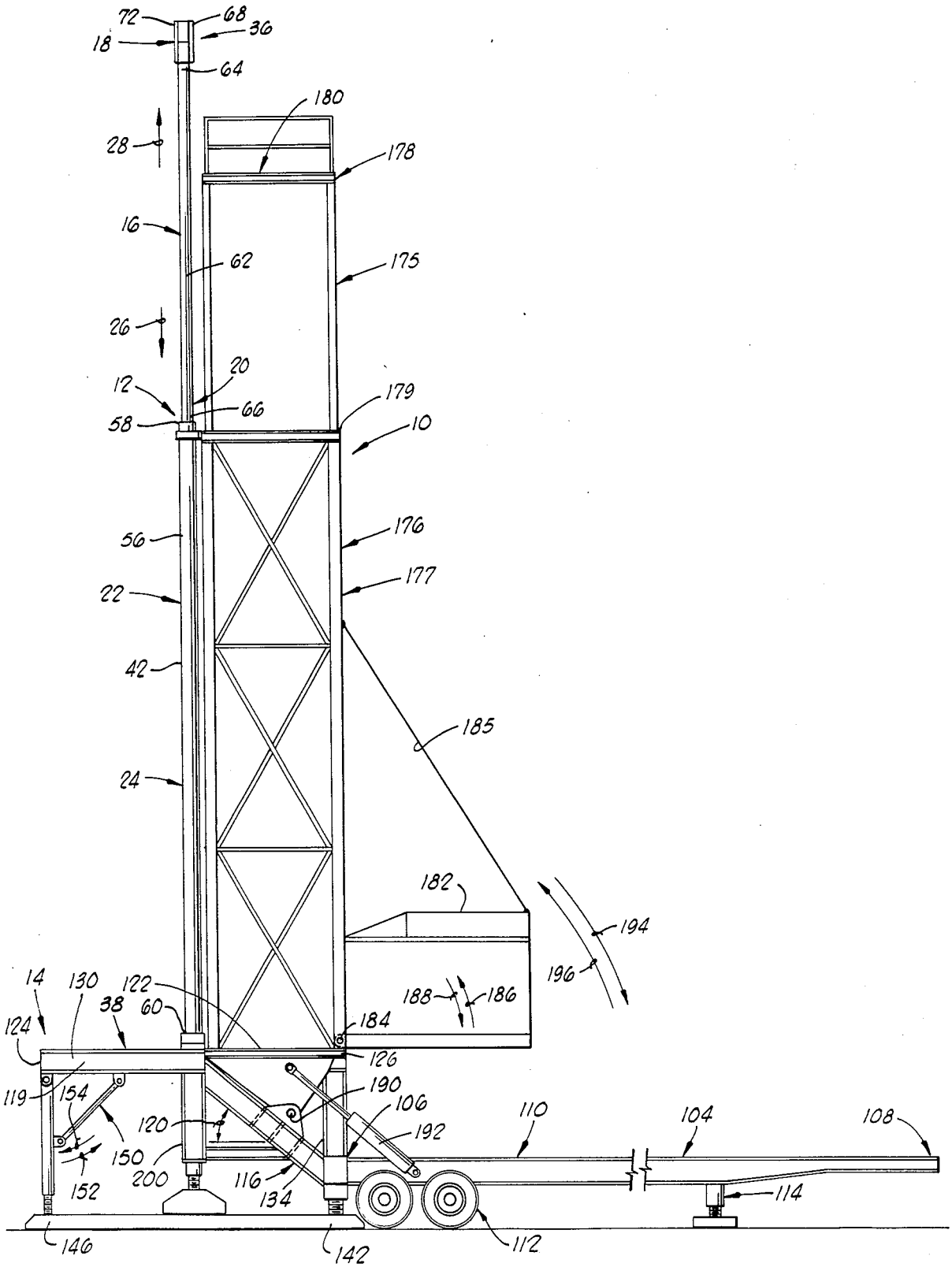
FIG. 1 is a side elevational view of a drilling rig with a hoist which is constructed in accordance with the present invention, showing the hoist in the raised position.
Figure 2:
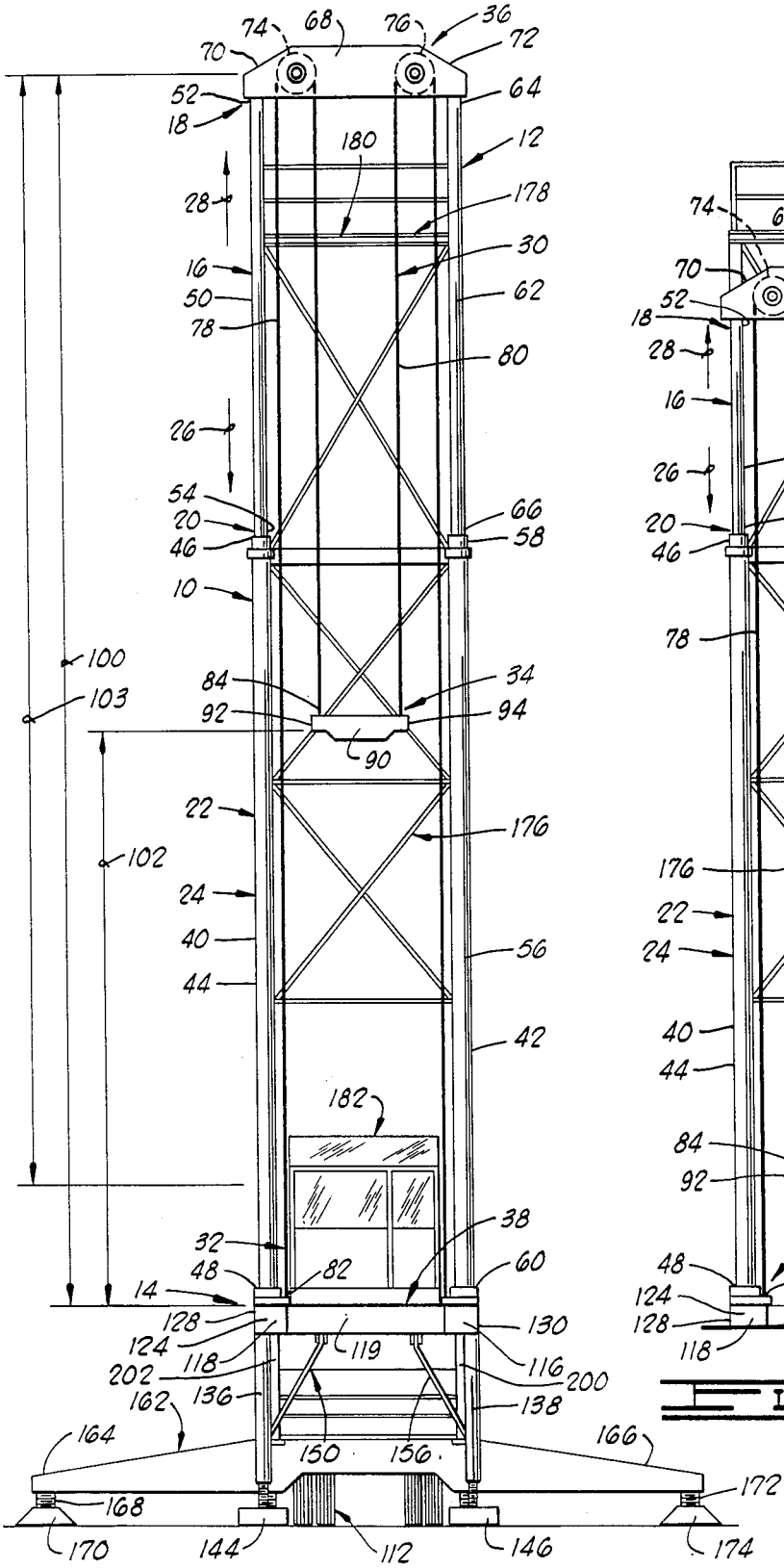
FIG. 2 is an end elevational view of the drilling rig with the hoist of FIG. 1, showing the hoist in the raised position.

Referring to the drawings in general and to FIGS. 1 and 2 in particular, shown therein and designated by the general reference numeral 10 is a drilling rig which is constructed in accordance with the present invention. The drilling rig 10 includes a hoist 12 comprising: a base assembly 14; a rod assembly 16 having an upper end portion 18 and a lower end portion 20; a rod assembly support 22 which is adapted for supporting the rod assembly 16 on the base assembly 14; a rod moving assembly 24 which is connected to the rod assembly 16 and adapted to move the rod assembly 16 in a raising direction 28 to a raised position (shown in FIGS. 1 and 2) and to move the rod assembly 16 in a lowering direction 26 to a lowered position (shown in FIG. 3) a cable assembly 30 having one end portion 32 which is anchored to the base assembly 14 and an opposite equipment end portion 34 which is adapted to be connected to equipment for raising and lowering the equipment connected thereto; a pulley assembly 36 for movably connecting a portion of the cable assembly 30 to the upper end portion 18 of the rod assembly 16.

The base assembly 14 has an upper surface forming a working floor 38, and the hoist 12 is supported generally on and extends vertically upwardly from the working floor 38 of the base assembly 14. The rod assembly 16 includes a first hydraulic cylinder 40 and a second hydraulic cylinder 42.

The first hydraulic cylinder 40 has a cylinder base 44 with opposite ends 46 and 48 and a cylinder rod 50 having opposite ends 52 and 54. A portion of the cylinder rod 50, generally near the end 54 thereof, is reciprocatingly disposed in the end 46 of cylinder base 44.

The second hydraulic cylinder 42 has a cylinder base 56 with opposite ends 58 and 60 and a cylinder rod 62 having opposite ends 64 and 66. A portion of the cylinder rod 62, generally near the end 62 thereof, is reciprocatingly disposed in the end 58 of the cylinder base 56.

The lower end 48 and 60 of each respective cylinder base 44 and 56 is secured to the working floor 38 of the base assembly 14. Each hydraulic cylinder 40 and 42 extends a distance generally vertically upwardly from the working floor 38 with the cylinder rods 50 and 62 being disposed in the ends 46 and 58 of the respective cylinder bases 44 and 56, opposite the ends 48 and 60 which are secured to the working floor 38. The first hydraulic cylinder 40 is spaced a distance from the second hydraulic cylinder 42. The cylinder rods 50 and 62 cooperate to comprise the rod assembly 16 and the cylinder bases 44 and 56 cooperate to comprise rod support assembly 22, the hydraulic cylinders 40 and 42 cooperating to comprise the rod moving assembly 24.

The hydraulic cylinders 40 and 42 are commercially available and are adapted to reciprocatingly move the respective cylinder rods 50 and 62 from a lowered position (shown in FIG. 3) in the raising direction 28 to the raised position (Shown in FIGS. 1 and 2), and to reciprocatingly move the respective cylinder rods 50 and 62 from the raised position in the lowering direction 26 to the lowered position, during the operation of the hoist 12. The construction and the operation of hydraulic cylinders to reciprocatingly move cylinder rods in a manner just described with respect to the hydraulic cylinders 40 and 42 are well known in the art.

The hoist 12 includes a lift yoke 68 having opposite ends 70 and 72. One end 70 portion of the lift yoke 68 is securedly connected to the upper end 52 portion of the cylinder rod 50 of the first hydraulic cylinder 40. The opposite end 72 portion of the lift yoke 68 is securedly connected to the upper end 64 portion of the cylinder rod 62 of the second hydraulic cylinder 42. The lift yoke 68 structurally connects the upper end 52 and 62 portions of the respective cylinder rods 50 and 62 during the movement of the cylinder rods 50 and 62 in the raising and the lowering directions 26 and 28 during the operation of the hoist 12.

The pulley assembly 36 includes a first pulley 74 and a second pulley 76. The first pulley 74 is rotatingly supported on the upper end 52 portion of the cylinder rod 50 of the first hydraulic cylinder 44 and the second pulley 76 is rotatingly supported on the upper end 64 portion of the cylinder rod 62 of the second hydraulic cylinder 56. As shown more clearly in FIGS. 2 and 3, the first and the second pulleys 74 and 76, more particularly, are each rotatingly supported in a spaced apart relationship on the lift yoke 68 and the lift yoke 68 cooperates to support the pulleys 74 and 76 on the respective cylinder rods 50 and 62.

The cable assembly 30 includes a first cable 78 and a second cable 80. The first cable 78 has an end 82 and an opposite equipment end 84 portion, and the second cable 80 has an end 86 and an opposite equipment end 88 portion. The end 82 of the first cable 78 is securedly connected to the working floor 38 of the base assembly 14 or, more particularly, to the cylinder base 44 of the first hydraulic cylinder 40, generally near the end 48 of the cylinder base 44. The end 86 of the second cable 80 is securedly connected to the working floor 38 of the base assembly 14 or, more particularly, to the cylinder base 56 of the second hydraulic cylinder 42, generally near the end 60 of the cylinder base 56.

It should be noted that, in one form, two or more pulleys, each with a cable, would be substituted for each of the first pulley 74 and second pulley 76. In this manner, more than two cables would be utilized to support the load and, thus, smaller diameter cables could be utilized as compared to the diameters of the two cables 78 and 80.

The first cable 78 extends from the working floor 38 or, more particularly, the cylinder base 44 of the first hydraulic cylinder 40 upwardly and over the first pulley 74, the first cable 78 being moveably connected to the first pulley 74. The first cable 78 extends from the first pulley 74 a distance generally downwardly terminating with the equipment end portion 84.

The second cable 80 extends from the working floor 38 or, more particularly, the cylinder base 56 of the second hydraulic cylinder 42 upwardly and over the second pulley 76, the second cable 80 being moveably connected to the second pulley 76. The second cable 80 extends from the second pulley 76 a distance downwardly terminating with the equipment end portion 88.

Figure 3:
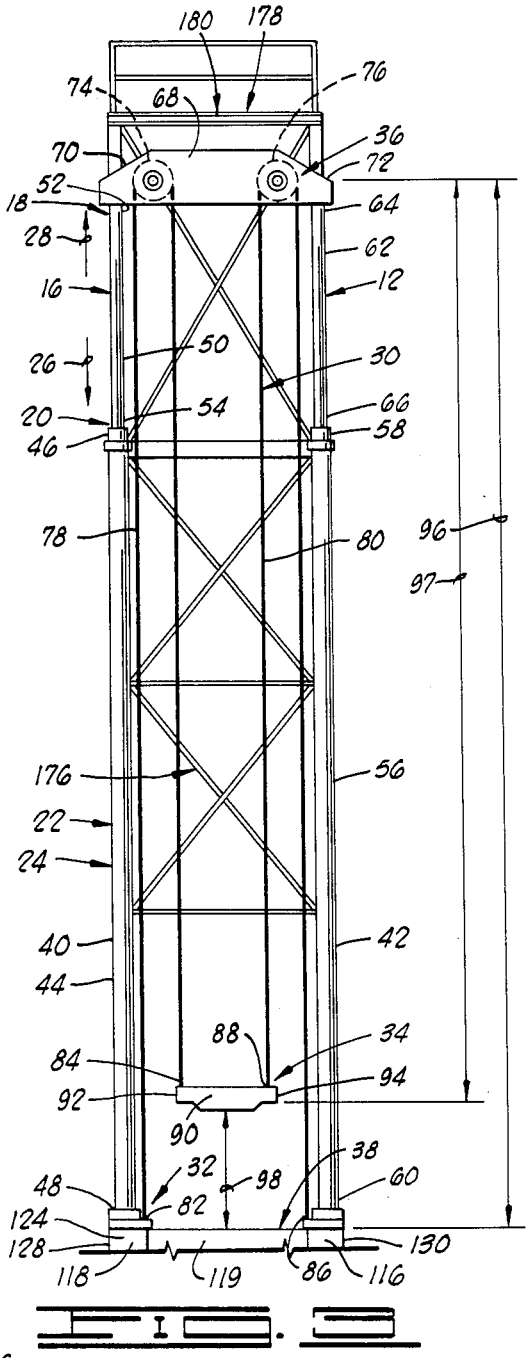
FIG. 3 is a partial end elevational view of a portion of the drilling rig of FIGS. 1 and 2, showing the hoist in the lowered position.

The equipment end portions 84 and 88 of the first and second cables 78 and 80 cooperate to form the equipment end portion 34 of the cable assembly 30. As shown in FIGS. 2 and 3, the hoist 12 includes a tool bar 90 having opposite ends 92 and 94. The equipment end portion 84 of the first cable 78 is connected to the tool bar 90, generally near the end 92 of the tool bar 90, and the equipment end portion 88 of the second cable 80 is connected to the tool bar 90, generally near the end 94 of the tool bar 90. The tool bar 90 is adapted to be removably connected to the equipment to be raised and lowered by the hoist 12, although in another form the equipment end portions 84 and 88 of the first and the second cables 78 and 80 could be directly connected to the equipment to be raised and lowered by the hoist 12.

As shown in FIG. 3, the equipment end portions 84 and 88 and the tool bar 90 connected thereto are positioned a distance 97 from the upper end 62 and 64 portions of the cylinder rods 50 and 62 in the lowered position of the rod assembly 16, the upper end 52 and 64 portions of the cylinder rods 50 and 62 being spaced a lowered distance 96 above the working floor 38 in this lowered position. In the lowered position of the rod assembly 16, the tool bar 90 is supported a distance 98 generally above the working floor 38.

As shown in FIG. 3, the equipment end portions 84 and 88 and the tool bar 90 connected thereto are positioned generally near the upper end 52 and 64 portions of the cylinder rods 50 and 62 in the raised position of the rod assembly 16. In the raised position of the rod assembly 16, the tool bar 90 is supported a distance 102 above the working floor 38, the upper end 52 and 64 portions of the cylinder rods 50 and 62 are positioned a distance 100 above the working floor 38, and the upper end 52 and 64 portions of the cylinder rods 50 and 62 are positioned a distance 103 above the position of the tool bar 90 in the lowered position of the rod assembly 16.

The upper end 52 and 64 portions of the cylinder rods 50 and 62 travel a distance equal to the difference between the distance 103 and the distance 97 as the hoist 12 is moved from the lowered position (FIG. 3) to the raised position (FIG. 1) or from the raised position to the lowered position. The cable assembly 30 and the pulley assembly 36 are arranged so that the tool bar 90 travels a distance approximately equal to twice the distance of travel of the upper end 52 and 64 portions of the cylinder rods 50 and 62 as the hoist 12 is moved from the lowered position to the raised position or from the raised position to the lowered position.

The drilling rig 10 with the hoist 12 is constructed to be transported from one location to another by a vehicle (not shown in the drawings) which is removably connectable to a trailer 104. The trailer 104 has opposite ends 106 and 108, and a trailer bed 110. The trailer 104 is rollingly supported by wheels 112 and the end 108 is adapted to be removably connectable to the vehicle, such as a truck, for example, in a conventional manner. The drilling rig 10 is moveably connected to the trailer 104 in such a manner that the drilling rig 10 is moveable from the trailer bed 110 to a working position (shown in FIGS. 1 and 2) wherein the working floor 38 of the base assembly 14 is disposed generally in a horizontal plane a distance above the ground, and moveable from the working position to a transport position (not shown) wherein the drilling rig 10 generally is supported on the trailer bed 110. A trailer jack 114 is connected to the trailer 104, generally near the end 108 thereof, the trailer jack 114 being adapted to cooperate with the wheels 112 in supporting the trailer 104 when the trailer 104 is disconnected from the vehicle, as shown in FIG. 1.

A pair of extension beams 116 and 118 are connected to the trailer 104. One end of each extension beam 116 and 118 is connected to the trailer 104, generally near the end 106 of the trailer 104, and each of the extension beams 116 and 118 extends a distance from the end 106 of trailer 104 angularly upwardly at an angle 120. The extension beam 116 is connected generally near one side of the trailer 104 and the other extension beam 118 is connected generally near the opposite side of the trailer 104, the extension beams 116 and 118 being supported in a spaced apart relationship. A portion of each extension beam 116 and 118, opposite the ends of the extension beams 116 and 118 which are connected to the trailer 104, extends a distance generally away from the trailer 104 and is disposed in a horizontal plane. A floor structure 119 connects the horizontally extending portions of the extension beams 116 and 118, the floor structure 119 forming a portion of the working floor 38.

The base assembly 14 includes the extension beams 116 and 118 and a base 122. The base assembly 14 has opposite ends 124 and 126 and opposite sides 128 and 130. A portion of the working floor 38 is formed on the upper surface of the base 122. The base assembly 14 is supported a distance above the ground in a position wherein the working floor 38 extends in a generally horizontal plane by four support jacks, only three support jacks 134, 136 and 138 being shown in FIGS. 1 and 2. The four support jacks 134, 136 and 138 (one not shown) are generally positioned at the four corners of the base assembly 14 and each of the support jacks 134, 136 and 138 (one not shown) extends generally perpendicularly and downwardly. More particularly, the support jacks 136 and 138 are connected to the horizontally extending portions of the extension beams 116 and 118 and the other two support jacks 134 and the one not shown are connected to the base 122. The end of each of the support jacks 134, 136 and 138, (one not shown) opposite the ends which are connected to the base assembly 14, has a ground engaging pad connected thereto which is adapted to engage the ground, only three of the respective ground engaging pads being designated in the drawings by the reference numerals 142, 144 and 146. Each of the support jacks 134, 136 and 138 (one not shown) is of the commercially available type of support jack, and each support jack 134, 136 and 138 (one not shown) is adjusted so that the position of the respective ground engaging pads 142, 144 and 146 (one not shown) is adjustable to engage the ground for supporting the base assembly 14 or, more particularly, the working floor 38 generally in a horizontal plane a distance above the ground. In one preferred form, the ground engaging pads 142 and 146 are integrally connected to form a unitary structure and, in a like manner, the ground engaging pad 144 is integrally connected to the ground engaging pad (not shown) to form a unitary structure.

One end of a first bar 150 is connected to the base assembly 14 via a removable pin and the opposite end of the bar 150 is connected via a removable pin to a portion of the support jack 136 generally between the opposite ends of the support jack 136. The first bar 150 cooperates to secure the support jack 136 in a ground engaging position (shown in FIGS. 1 and 2).

One end of a second bar 156 is connected to the base assembly 14 via a removable pin and the opposite end of the bar 156 is connected via a removable pin to a portion of the support jack 138, generally between the opposite ends of the support jack 138. The bar 156 cooperates to secure the support jack 138 in a ground engaging position (shown in FIGS. 1 and 2).

The base assembly 14 also includes an outrigger 162 which is connected to the base 122, generally between the opposite ends 124 and 126 of the base 122. The outrigger 162 has one end 164 portion which extends a distance from the side 128 of the base 122 and an opposite end 166 portion which extends in an opposite direction a distance from the side 130 of the base 122. An outrigger jack 168 is connected to the outrigger 162 generally near the end 164 thereof and the outrigger jack 168 includes a ground engaging portion 170. An outrigger jack 172 is connected to the outrigger 162 generally near the end 166 thereof and the outrigger jack 172 includes a ground engaging portion 174. In one preferred form, the outrigger 162 also includes two additional spaced apart outrigger jacks (not shown) disposed generally between the opposite ends 164 and 166. The outrigger jacks 168 and 172 are of the commercially available type and each outrigger jack 168 and 172 is adjustable to move the respective ground engaging portions 170 and 174 into engagement with the ground. The outrigger 162 cooperates to support the base assembly 14 or, more particularly, the working floor 38 in a generally horizontal plane a distance above the ground and provides additional lateral support for supporting the base assembly 14 against wind loads. The outrigger 162 and the support jacks 134, 136 and 138 (one not shown) cooperate to support the base assembly 14 and eliminate the necessity of using wires or cables for securing the drilling rig 10 in the working position.

The drilling rig 10 also includes a mast 176 having one end secured to the working floor 38, the mast 176 extending a distance generally perpendicularly upwardly from the working floor 38 terminating with an upper end 178. The mast 176 has an upper mast portion 175 and a lower mast portion 177. The upper mast portion 175 is telescopingly connected to the lower mast portion 177 so the upper mast portion 175 can be telescoped into the lower mast portion 177 to position the mast 176 in a transport position, the upper mast portion 175 being telescopingly connected to the lower mast portion 177 generally at 179.

A conventional pipe rack 180 is connected to a portion of the upper end 178 and the pipe rack 180 cooperates to support a plurality of drill pipes (not shown) generally on the working floor 38 for use during the drilling operation.

One end of a control building 182 is pivotally connected to the mast 176, generally near the connection of the mast 176 to the base assembly 14, at a pivot connection 184. One end of a cable support 185 is connected to the control building 182 and the opposite end of the cable support 185 is connected to the lower mast portion 177. In a working embodiment, it would be preferred to utilize more than one cable to support the control building 182.

In a working position, the control building 182 extends a distance generally perpendicularly from the mast 176 and the floor of the control building 182 is in a horizontal plane generally coplanar with the planar disposition of the working floor 38, as indicated in FIGS. 1 and 2, the control building 182 being supported in this position by one cable support 185. The control building 182 is pivotable in a direction 186 generally toward the mast 176 to a transport position (not shown) wherein the control building 182 is generally disposed within the structural support members of the mast 176, and the control building 182 is pivotable via gravity in a direction 188 to a working position (shown in FIGS. 1 and 2).

The base 122 is pivotally connected to the extension beams 116 and 118 at a pair of pivot connections 190 (only one pivot connection 190 being shown in the drawings).

One end of a pair of hydraulic cylinders 192 is pivotally connected to the base 122 or the mast 176 and the opposite end of each hydraulic cylinder 192 is pivotally connected to the trailer 104, one of the hydraulic cylinders 192 being shown in FIG. 1. The hydraulic cylinders 192 are constructed and connected to the base 122 or the mast 176 to pivot the mast 176 and the components connected thereto in a direction 194 generally toward the trailer bed 110 to a transport position wherein the mast 176 is supported on the trailer bed 110, and to pivot the mast 176 and the components connected thereto in a direction 196 generally away from the trailer bed 110 to a working position (shown in FIGS. 1 and 2).

One end of a first cylinder support jack 202 is connected to the base 122 generally below the first hydraulic cylinder 40 and a second cylinder support jack 200 is connected to the base 122 generally below the second hydraulic cylinder 42. The cylinder support jacks 200 and 202 each are constructed similar to the support jacks 134, 136 and 138, and the cylinder support jacks 200 and 202 each include a ground engaging portion. The cylinder support jacks 200 and 202 cooperate to transfer or transmit the load imposed on the hydraulic cylinders 40 and 42 during the operation of the hoist 12 to the ground.

In the transport position, the drilling rig 10 is supported on the trailer bed 110 and, in this transport position the drilling rig 10 can be transported to remote locations using a vehicle (not shown) to pull the trailer 104 with the drilling rig 10 supported thereon. When the drilling rig 10 has been transported to a desired location or site, the trailer jack 114 is adjusted to engage the ground and cooperate with the wheels 112 to support the trailer 104 in a stationary position (shown in FIGS. 1 and 2). Then, the vehicle (not shown) is disconnected from the trailer 104.

The outrigger 162 is positioned in a ground engaging position or, more particularly, the outrigger jacks 168 and 172 are positioned in the ground engaging position. The support jacks 136 and 138 each are moved in the direction 154 to a position wherein each of the support jacks 136 and 138 extend generally perpendicularly from the working floor 38, the bars 150 and 156 being connected to the respective jacks 136 and 138 and to the base assembly 14 to secure the jacks 136 and 138 in position. Also, the support jack 134 and the other support jack (not shown) is positioned in a ground engaging position, and the cylinder support jacks 200 and 202 are positioned in a ground engaging position.

The hydraulic cylinders 192 then are actuated to pivotingly move the drilling rig 10 in the direction 196 generally away from the trailer bed 110 toward the working position. When the drilling rig 10 has been moved in the direction 196 to a position wherein the working floor 38 is disposed generally in a horizontal plane and the base assembly 14 is supported generally on the support jacks 134, 136 and 138 (one not shown), the outrigger 162 and the cylinder support jacks 200 and 202, the hydraulic cylinders 192 are actuated to cease movement of the drilling rig 10. In this position, the support jacks 134, 136 and 138 (one not shown), the outrigger jacks 168 and 172 and the cylinder support jacks 200 and 202 each are adjusted to a position to move the base assembly 14 into a position wherein the working floor 38 extends generally in a horizontal plane a distance above the ground.

The control building 182 is pivoted by gravity in the direction 188 to a working position (shown in FIGS. 1 and 2) while the mast 176 is being moved to the working position.

In the working position of the drilling rig 10 (shown in FIGS. 1 and 2), the hoist 12 is utilized to raise and lower equipment relative to the working floor 38 during various aspects of the drilling operations. The equipment to be raised or lowered, first is secured to the tool bar 90 and then the first and the second hydraulic cylinders 40 and 42 are actuated to raise or lower the tool bar 190 and the equipment connected thereto in the respective raising and lowering directions 26 and 28 as desired. Since the cables 78 and 80 are constructed of a flexible material, the cables 78 and 80 with the tool bar 90 connected thereto can be moved in generally radial or horizontal directions extending generally perpendicularly with respect to the raising and lowering directions 26 and 28 to facilitate the connecting of equipment to the tool bar 90. This last-mentioned aspect is particularly useful in connecting drill pipe (not shown) to the cables 78 and 80, since the cables 78 and 80 can be moved to the drill pipe located in the pipe rack 180 for connecting a drill pipe to the cables 78 and 80 and then moved back to a vertically extending position for lowering the drill pipe connected thereto in the lowering direction 28. The load carried by the hoist 12 is supported on the working floor 38 and transmitted to the ground via the cylinder support jacks 200 and 202. It should be noted that the cylinder support jacks 200 and 202 can be part of the outrigger 162.

As mentioned, the hoist 12 is useful for raising and lowering equipment relative to the working floor 38. In a typical drilling operation, a swivel or drill pipe would comprise the equipment contemplated to be raised and lowered using the hoist 12, although it specifically should be understood that various other equipment or tools are contemplated by the term "equipment" as used herein and the swivel and drill pipe have been mentioned only by way of example.

Figure 4:
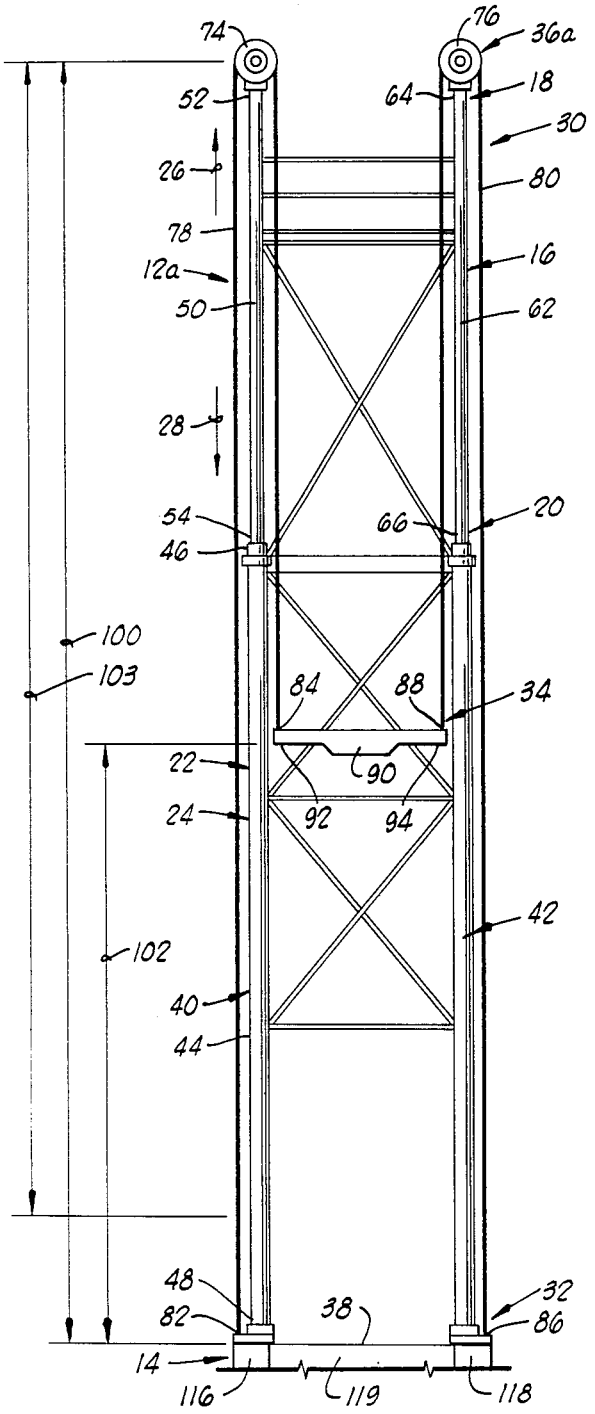
FIG. 4 is a partial end elevational view showing a modified hoist in the raised position
Figure 5:
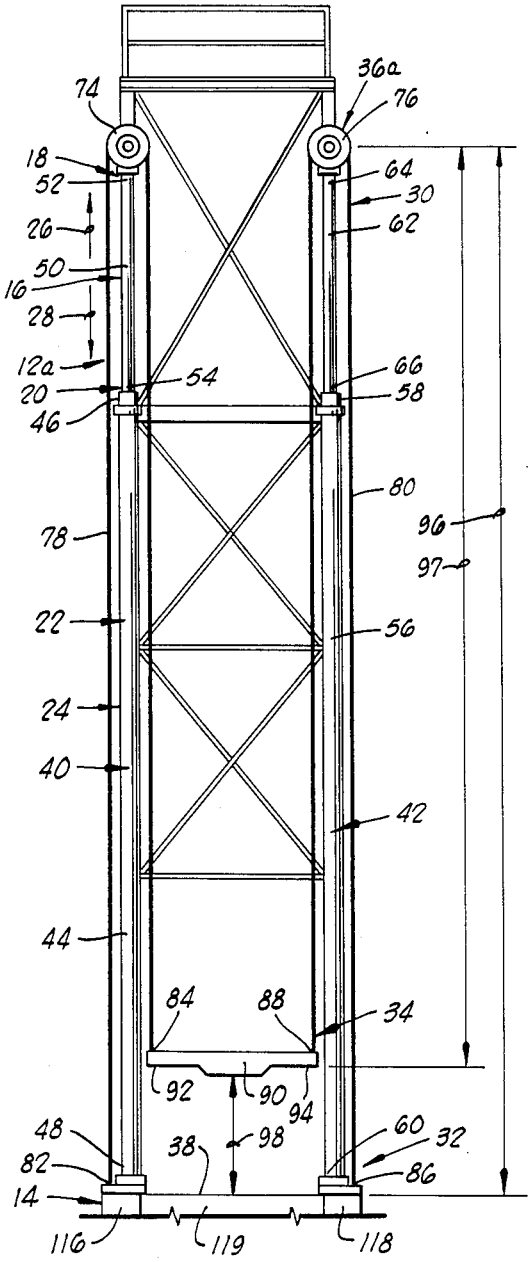
FIG. 5 is an end elevational view, showing the modified hoist of FIG. 4 in the lowered position.

Embodiment of FIGS. 4 and 5

Shown in FIGS. 4 and 5 is a modified hoist **12*a* which is constructed and operates exactly like the hoist 12 described before, except the modified hoist 12*a* includes a modified pulley assembly 36*a*. The first pulley 74 is rotatingly connected to the upper end 52 of the cylinder rod 50 of the first hydraulic cylinder 40 and the second pulley 76 is rotatingly connected to the upper end 64 of the cylinder rod 62 of the second hydraulic cylinder 42. Thus, the modified hoist 12*a* does not include lift yoke such as the lift yoke 68 described before and the pulleys 74 and 76 are connected directly to the respective cylinder rods 50 and 62**.

Changes may be made in the construction and the operation of the various assemblies and components described herein without departing from the spirit and the scope of the invention as defined in the following claims.

What is claimed is:

1. A hoist adapted for raising and lowering equipment relative to the ground, the hoist being transportable via a vehicle connected to a trailer having a trailer bed, the hoist comprising:

a base adapted to be supported from the ground;

a first and a second hydraulic cylinder disposed in a spaced apart relationship, each hydraulic cylinder having a cylinder base with opposite ends and a cylinder rod with opposite ends, one end portion of each cylinder rod being reciprocatingly disposed in one end of one of the cylinder bases and the opposite end portion of each cylinder rod extending a distance from the respective cylinder base and terminating with an upper end portion of the cylinder rods, each hydraulic cylinder being adapted for moving the cylinder rod reciprocatingly disposed therein in a raising direction generally away from the base to a raised position wherein the upper end portions of the cylinder rods extend a raised distance above the base and in a lowering direction generally toward the base to a lowered position wherein the upper end portions of the cylinder rods extend a lowered distance from the base, the end of each cylinder base generally opposite the end thereof having the cylinder rod reciprocatingly disposed therein being secured to the base;

means for moveably connecting at least a portion of the base to the trailer, a portion of the base with the first and the second hydraulic cylinders supported thereon being moveable to a transport position wherein the base and the first and the second hydraulic cylinders supported thereon are supported on the trailer bed for transporting the hoist from one location to another location and a portion of the base with the first and the second hydraulic cylinders supported thereon being moveable from the transport position to a working position wherein the base is disposed in a substantially horizontal plane spaced a distance above the ground;

means for supporting the base from the ground in the working position of the base comprising:

a plurality of support jacks, each support jack having one end portion connected to the base and an opposite end portion engageable with the ground, each support jack being moveable to a position wherein one end portion of each support jack engages the ground in the working position of the base for cooperatingly supporting the base for cooperatingly supporting the base in a substantially horizontal plane in the working position of the base, comprising:

a first cylinder support jack connected to the base generally under the first hydraulic cylinder and being adapted to cooperatingly support the base from the ground; and a second cylinder support jack connected to the base assembly generally under the second hydraulic cylinder and being adapted to cooperatingly support the base from the ground, the first and the second cylinder support jacks cooperating to transmit the load carried by the first and the second hydraulic cylinders to the ground;

a cable assembly having one end portion anchored to the base and an opposite equipment end portion adapted for being attached to the equipment; and means for movably connecting a portion of the cable assembly to the upper end portions of the cylinder rods of the first and second hydraulic cylinders, the cable assembly extending from the end portion anchored to the base, through the portion moveably connected to the upper end portions of the cylinder rods of the first and second hydraulic cylinders and to the opposite equipment end portion, the equipment end portion being positioned for supporting the equipment a distance above the base in the lowered position of the cylinder rods of the first and second hydraulic cylinders and the equipment end portion being positioned for supporting the equipment a greater distance above the base in the raised position of the cylinder rods of the first and second hydraulic cylinders, the equipment end portion of the cable assembly being moved in the raising direction as the cylinder rods of the first and second hydraulic cylinders are moved in the raising direction and the equipment end portion being moved in the lowering direction as the cylinder rods of the first and second hydraulic cylinders are moved in the lowering direction, the load of the equipment supported on the equipment end portion of the cable assembly being carried through the first and second hydraulic cylinders and through the first and second cylinder support jacks to the ground as the equipment is raised and lowered during the respective moving of the cylinder rods of the first and second hydraulic cylinders to the raised position and to the lowered position.

2. The hoist of claim 1 defined further to include:

a tool bar connected to the equipment end portion of the cable assembly and being adapted for removably connecting equipment thereto.

3. The hoist of claim 1 wherein the cable assembly is defined further as being constructed of a relatively flexible material for permitting movement of the equipment end portion of the cable assembly in a plane generally horizontal to the ground to facilitate the connecting and removal of equipment to the equipment end portion of the cable assembly.

4. The hoist of claim 1 wherein the cable assembly is defined further to include a first cable and a second cable, and wherein the means for movably connecting a portion of the cable assembly to the upper end portions of the cylinder rods of the first and second hydraulic cylinders is defined further to include:

a first pulley rotatingly supported on the upper end portion of the cylinder rod of the first hydraulic cylinder, one end of the first cable being connected to the base and the first cable extending from the connection thereof to the base over the first pulley to an equipment end portion thereof, the first pulley moveably connecting the first cable to the cylinder rod of the first hydraulic cylinder; and a second pulley rotatingly supported on the upper end portion of the cylinder rod of the second hydraulic cylinder, one end of the second cable being connected to the base and the second cable extending from the connection thereof to the base over the second pulley to an equipment end portion thereof, the second pulley moveably connecting the second cable to the cylinder rod of the second hydraulic cylinder.

5. The hoist of claim 4 defined further to include:

a lift yoke having one end portion connected to the upper end portion of the cylinder rod of the first hydraulic cylinder and an opposite end portion connected to the upper end portion of the second hydraulic cylinder; and wherein the first and the second pulleys are each defined further as being rotatingly connected to the lift yoke, the lift yoke cooperating to support the first and the second pulleys on the respective upper end portions of the first and the second hydraulic cylinders, the lift yoke cooperating to facilitate the synchronous movement of the cylinder rods of the first and the second hydraulic cylinders during the movement of the cylinder rods from the raised position to the lowered position and from the lowered position to the raised position.

6. The hoist of claim 5, wherein the first cable is defined further as having one end thereof secured to the cylinder base of the first hydraulic cylinder thereby securing the first cable to the base, and wherein the second cable is defined further as having one end thereof secured to the cylinder base of the second hydraulic cylinder thereby securing the second cable to the base.

7. The hoist of claim 1 wherein the first and the second hydraulic cylinders are each defined further as extending a distance generally vertically from the base.

8. The hoist of claim 1 wherein the means for supporting the base from the ground in the working position of the base is defined further to include:

an outrigger connected to the base, the outrigger having a first end extending a distance in a first direction from the base and an opposite second end extending a distance in an opposite second direction from the base;

a first outrigger jack connected to the first end of the outrigger and having a moveable portion engagable with the ground; and a second outrigger jack connected to the second end of the outrigger and having a moveable portion engagable with the ground, the outrigger being adapted for providing support for cooperating to support the base in the working position.

9. The hoist of claim 1 defined further to include:

a mast having one end connected to the base, the mast extending a distance generally perpendicularly from the base terminating with an opposite end portion.

10. The hoist of claim 9 defined further to include:

a control building pivotally connected to the base.

* * * * *